US007365719B2

(12) United States Patent
Miyagawa

(10) Patent No.: US 7,365,719 B2
(45) Date of Patent: Apr. 29, 2008

(54) DISPLAY DEVICE

(75) Inventor: Keisuke Miyagawa, Atsugi (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 598 days.

(21) Appl. No.: 10/833,123

(22) Filed: Apr. 28, 2004

(65) Prior Publication Data

US 2004/0252085 A1 Dec. 16, 2004

(30) Foreign Application Priority Data

May 16, 2003 (JP) ..... 2003-139665

(51) Int. Cl.
*G09G 3/32* (2006.01)
*G09G 3/20* (2006.01)

(52) U.S. Cl. ..... 345/82; 345/55; 345/76

(58) Field of Classification Search ..... 345/55, 345/76, 77, 80, 82, 83
See application file for complete search history.

(56) References Cited

U.S. PATENT DOCUMENTS

| | | | | |
|---|---|---|---|---|
| 6,011,529 | A | 1/2000 | Ikeda | |
| 6,229,506 | B1 * | 5/2001 | Dawson et al. | 345/82 |
| 6,548,960 | B2 | 4/2003 | Inukai | |
| 6,583,775 | B1 | 6/2003 | Sekiya et al. | |
| 6,753,854 | B1 | 6/2004 | Koyama et al. | |
| 6,756,740 | B2 | 6/2004 | Inukai | |
| 6,781,153 | B2 | 8/2004 | Anzai | |
| 6,784,454 | B2 | 8/2004 | Anzai | |

(Continued)

FOREIGN PATENT DOCUMENTS

CN 1323023 11/2001

(Continued)

OTHER PUBLICATIONS

S. Kanbe et al., *Patterning of High Performance Poly*(dialkylfluorene) *Derivatives for Light-Emitting Full Color Display by Ink-Jet Printing*, Base Technology Research Center, Seiko Epson Corporation, Proc. Euro Display, 1999, pp. 85-88.

(Continued)

*Primary Examiner*—My-Chau T. Tran
(74) *Attorney, Agent, or Firm*—Eric J. Robinson; Robinson Intellectual Property Law Office, P.C.

(57) ABSTRACT

By operating a driving TFT in a saturation region, luminance is not easily reduced when an EL element is degraded. However, such problems occur as a high voltage, high power consumption, and heat generation. In the case of operating a driving TFT in a saturation region, luminance varies due to a variation of driving TFTs. In view of the aforementioned problems, a high current capacity TFT is used in the high gray-scale and a low current capacity TFT is used in the low gray-scale. The high current capacity TFT can supply a large current with a lower Vgs, therefore, it does not easily operate in a linear region even when Vds is lowered. Thus, a luminance is not reduced easily even when an EL element is degraded, and an operation at a low voltage is realized. The low current capacity TFT supplies current when high Vgs is applied. With high Vgs, an effect of variation in characteristics of TFTs, especially in Vth can be ameliorated.

28 Claims, 15 Drawing Sheets

U.S. PATENT DOCUMENTS

| | | | | |
|---|---|---|---|---|
| 6,798,405 | B2 | 9/2004 | Anzai | |
| 7,109,952 | B2 * | 9/2006 | Kwon | 345/76 |
| 2002/0074580 | A1 | 6/2002 | Anzai et al. | |
| 2002/0075254 | A1 | 6/2002 | Anzai | |
| 2002/0084746 | A1 | 7/2002 | Anzai | |
| 2002/0101394 | A1 | 8/2002 | Anzai | |
| 2003/0090481 | A1 | 5/2003 | Kimura | |
| 2003/0160745 | A1 | 8/2003 | Osame et al. | |
| 2004/0041754 | A1 | 3/2004 | Inukai | |
| 2004/0164303 | A1 | 8/2004 | Anzai | |
| 2004/0207578 | A1 | 10/2004 | Koyama | |
| 2004/0263440 | A1 | 12/2004 | Kimura et al. | |
| 2005/0062692 | A1 * | 3/2005 | Lo et al. | 345/76 |
| 2005/0140609 | A1 | 6/2005 | Akimoto et al. | |

FOREIGN PATENT DOCUMENTS

| | | |
|---|---|---|
| EP | 1 193 676 | 4/2002 |
| EP | 1 310 937 | 5/2003 |

OTHER PUBLICATIONS

M. Mizukami et al., *6-Bit Digital VGA OLED*, SID 00 Digest, 2000, pp. 912-915.

K. Inukai et al., *Late-News Paper: 4.0-in. TFT-OLED Displays and a Novel Digital Driving Method*, SID 00 Digest, 2000, pp. 924-927.

S. Miyashita et al., *Full Color Displays Fabricated by Ink-Jet Printing*, Asia Display/IDW ;01, 2001, pp. 1399-1402.

R.M.A. Dawson et al., *Design of an Improved Pixel for a Polysilicon Active-Matrix Organic LED Display*, SID 98 Digest, 1998, pp. 11-14.

T. Sasaoka et al., *Late-News Paper: A 13.0-inch AM-OLED Display with Top Emitting Structure and Adaptive Current Mode Programmed Pixel Circuit (TAC)*, SID 01 Digest, 2001, pp. 384-387.

A. Yumoto et al., *Pixel-Driving Methods for Large-Sized Poly-Si AM-OLED Displays*, Asia Display/IDW '01, 2001, pp. 1395-1398.

R. Hattori et al., *Current-Writing Active-Matrix Circuit for Organic Light-Emitting Diode Display Using a-Si:H Thin-Film-Transistors*, IEICE Transactions on Electronics, vol. E83-C, No. 5, May, 2000, pp. 779-782.

Y. He et al., *Current-Source a-Si:H Thin-Film Transistor Circuit for Active-Matrix Organic Light-Emitting Displays*, IEEE Electron Device Letters, vol. 21, No. 12, Dec. 2000, pp. 590-592.

R.M.A. Dawson et al., *The Impact of the Transient Response of Organic Light Emitting Diodes on the Design of Active Martrix OLED Displays*, IEDM 98, 1998, pp. 875-878.

M.T. Johnson, et al., *Active Matrix PolyLED Displays*, IDW '00, 2000, pp. 235-238.

Office Action (Application No. 200410045655.7) dated Jan. 4, 2008.

* cited by examiner

PRIOR ART

PRIOR ART

PRIOR ART

DISPLAY DEVICE

BACKGROUND OF THE INVENTION

1. Field of the Invention

The invention relates to a display device having a transistor. More specifically, the invention relates to a display device having an EL element and a thin film transistor (hereinafter referred to as a TFT) and the like formed on an insulator. Further, the invention relates to an electronic device having such a display device.

2. Description of the Related Art

In recent years, a display device having a light emitting element such as an electro luminescence (EL) element is actively developed. The light emitting element emits light by itself and does not use backlight which is required in a liquid crystal display (LCD) and the like, therefore, it is highly visible and suitable for fabricating in a thin form. Furthermore, its viewing angle is almost unlimited.

Generally, an EL element emits light when a current is supplied. Therefore, a different pixel configuration from LCD is suggested (refer to Non-patent Document 1).

[Non-Patent Document 1]

"Material technology and fabrication of elements regarding an organic EL display", Technical Information Institute, January 2002, p. 179-195

SUMMARY OF THE INVENTION

In aforementioned Non-patent Document 1, by operating a driving TFT in a saturation region, a luminance is not easily reduced even when an EL element is degraded. However, a voltage with an estimated degradation has to be applied in advance, therefore, there are such problems as a high power consumption and heat generation caused by high voltage. Further, in the case of operating driving TFTs in a saturation region, luminance varies due to the variation of the driving TFTs. In view of the aforementioned problems, the invention provides a display device which is not affected by degradation of the EL elements, capable of operating with a low voltage, and has a circuit configuration that can ameliorate the effect of the variation of driving TFTs.

As a source and a drain of a TFT can be of the same structure, they are referred to as a first electrode and a second electrode in this specification. A state that a voltage over a threshold voltage is applied between the gate and source of a TFT and a current flows between the source and drain is referred to as being ON. Further, a state that a voltage below the threshold voltage is applied between the gate and source of a TFT and a current does not flow between the source and drain is referred to as being OFF. Note that a TFT is used as an element forming a display device in this specification, however, the invention is not limited to this. For example, a MOS transistor, an organic transistor, a bipolar transistor, a molecular transistor and the like may be used instead. A mechanical switch may be used as well.

In this specification, an EL element is used as a light emitting element, however, the invention is not limited to this. For example, a light emitting diode and the like may be used.

In a display device in which a driving TFT 101 and an EL element 102 are connected as shown in FIG. 1, the gate of the driving TFT 101 is connected to a signal terminal 103, a first terminal is connected to a first power supply terminal 104, a second terminal is connected to a first terminal of an EL element 102, a second terminal of the EL element 102 is connected to a second terminal of a power supply terminal 105. In the aforementioned display device, the driving TFT 101 controls a current flowing to the EL element 102 and determines luminance of the EL element 102. By operating the driving TFT 101 in a saturation region, a current Ids between the source and drain of the driving TFT 101 can be controlled by a voltage Vgs between the gate and source thereof. In FIG. 1, the driving TFT 101 may be an N-channel TFT or a P-channel TFT.

It should be noted that a terminal does not have to be actually provided as long as a wiring is electrically connected, although it is referred to as a terminal for convenience in this specification. Moreover, a voltage between the gate and source of the TFT is referred to as Vgs, a voltage between the source and drain of the TFT is referred to as Vds, a current between the drain and source of the TFT is referred to as Ids, and a threshold voltage of the TFT is referred to as Vth in this specification.

In the case of operating the driving TFT in a saturation region, the following two problems occur. The source terminal and the drain terminal are determined depending on a voltage applied to the driving TFT 101, therefore, a terminal on the first power supply terminal 104 side in FIG. 1 may be either a source terminal or a drain terminal. The source terminal and the drain terminal are determined depending on a voltage applied to the first and second electrodes of the driving TFT 101 and a polarity whether the driving TFT 101 is Nch TFT or Pch TFT.

A first problem is that the driving TFT 101 tends to be operated in a linear region especially in a high gray-scale in which a large current flows into the EL element 102. FIG. 2 shows Vds-Ids characteristic lines 201*a* and 201*b* of the driving TFT 101 and V-I characteristic lines 202*a* and 202*b* of the EL element 102 in load lines. The characteristic line 201*a* shows the case of a high gray-scale where Vgs is high and Ids is large and the characteristic line 201*b* shows the case of a low gray-scale where Vgs is low and Ids is small. Further, the characteristic line 202*a* shows the case before the EL element 102 is degraded, and the characteristic line 202*b* shows the case after the EL element 102 is degraded. Intersections of the characteristic lines 201*a* and 201*b*, and the characteristic lines 202*a* and 202*b* correspond to operation points 203*a* to 203*d*. When transferring from the characteristic line 202*a* to the characteristic line 202*b* due to the degradation of the EL element 102, the operation points 203*a* and 203*b* transfer to the operation points 203*c* and 203*d*. At this time, Vds of the driving TFT 101 is lowered. In the case of the characteristic line 201*a* of the high gray-scale in particular, a driving state is changed with the operation point 203*a* in a saturation region transfers to the operation point 203*c* in a linear region as shown in FIG. 2 when Vds is lowered. This is because higher Vds of the characteristic line 201*a* is included in a linear region since Vgs is high. It should be noted that Vgs=Vds is a border between a linear region and a saturation region, which is shown in a dotted line 204 in FIG. 2. In a linear region, Ids changes drastically when Vds changes, which changes a current to flow into the EL element 102. Thus, luminance changes and display quality is lowered because of an image persistence and the like. In a linear region, Ids does not change much when Vgs changes, therefore a luminance cannot be controlled easily by controlling Vgs. In order to avoid these problems, a voltage with an estimated degradation is applied so as not to be operated in a linear region, however, such problems occur as a high power consumption, a heat generation, and a faster degradation of a TFT element.

In the characteristic line 201*b* of the low gray-scale with small Ids, the driving TFT operates in a saturation region even when the operation point 203*b* transfers to the operation point 203*d*. This is because lower Vds of the characteristic line 201*b* is included in a saturation region since Vgs is low.

A second problem is that the EL element 102 is easily affected by variation in characteristics of TFTs especially in a low gray-scale where a small current flows to the EL element 102. FIG. 3 shows Vds-Ids characteristic lines 301*a* and 301*b* of the driving TFT 101 and V-I characteristic line 302 of the EL element 102 in load lines. The characteristic lines 301*a* and 301*b* show the case where a characteristic of the driving TFT 101 varies. Intersections of the characteristic lines 301*a*, 301*b* and 302 correspond to operation points 303*a* and 303*b*. Characteristics of TFTs are not uniform, but have variation in Vth, for example. When the characteristic line 301*a* transfers to the characteristic line 301*b* due to the variation in characteristic of the driving TFT 101, the operation point 303*a* transfers to the operation point 303*b*, which changes Ids. Ids is in proportion to $(Vgs-Vth)^2$, however, it is easily affected by the variation in Vth since Vgs is low in the low gray-scale with small Ids. This causes luminance variation of a display device and decrease of display quality.

In the high gray-scale with large Ids, Ids is not easily affected by the variation in Vth since Vgs is high.

In the invention, a high current capacity TFT is used in a high gray-scale (display) while a low current capacity TFT is used in a low gray-scale (display) as a driving TFT.

A high current capacity TFT is used as a driving TFT in a high gray-scale because it can supply a large current even with a lower Vgs, therefore, it does not operate in a linear region easily even when Vds is lowered. Therefore, luminance is not reduced when the EL element is degraded and operation with low voltage is possible. Thus, low power consumption and low heat generation can be realized, which prevents degradation of a TFT element.

A low current capacity TFT supplies current when high Vgs is applied. A low current capacity TFT is used for low gray-scale as a driving TFT because an effect of variation in characteristics of a TFT, in Vth particularly can be ameliorated by operating with a high Vgs. The use of this TFT is efficient particularly in the low gray-scale in which Vgs is low, and can enhance a display quality. Further, by designing a channel length L of the TFT long in order to suppress a current capacity, a variation in characteristics can be ameliorated.

A configuration of the invention is described now. A display device of the invention comprises at least a signal line which is inputted an analog signal, a scan line, a plurality of transistors, and a light emitting element. The display device further comprises a first transistor connected to a first signal line and the scan line, a first driving transistor connected to the light emitting element, a second transistor connected to a second signal line and the scan line, and a second driving transistor connected to the light emitting element.

A display device of the invention comprises at least a signal line which is inputted an analog signal, a scan line, a plurality of transistors, and a light emitting element. The display device further comprises a first transistor connected to a first signal line and the scan line, a first capacitor connected to the first transistor and a power supply line, a first driving transistor of which gate electrode is connected to the first capacitor and of which one electrode is connected to the light emitting element, a second transistor connected to a second signal line and the scan line, a second capacitor connected to the second transistor and the power supply line, and a second driving transistor of which gate electrode is connected to the second capacitor and of which one electrode is connected to the light emitting element.

In the aforementioned configuration, the first and the second driving transistors may have different current capacities. As another configuration, display in high gray-scale can be performed by making the current capacity of the first driving transistor higher than that of the second driving transistor. Further, display in low gray-scale can be performed by making the current capacity of the second driving transistor lower than that of the first driving transistor.

Furthermore, in the aforementioned configuration, a voltage between the gate and drain of the first driving transistor may be different from that of the second driving transistor.

The display device of the invention may comprise a unit for selecting a plurality of driving transistors connected to the light emitting element according to the luminance thereof.

According to the invention, by using a plurality of driving TFTs having different characteristics, an effect by the degradation of an EL element and variation in characteristic of the driving TFTs can be small and an operation at a low voltage is realized.

DETAILED DESCRIPTION OF THE INVENTION

Embodiment Mode 1

This application is based on Japanese Patent Application serial no. 2003-139665 filed in Japan Patent Office on 16 May, 2003, the contents of which are hereby incorporated by reference.

Although the present invention will be fully described by way of example with reference to the accompanying drawings, it is to be understood that various changes and modifications will be apparent to those skilled in the art. Therefore, unless otherwise such changes and modifications depart from the scope of the present invention, they should be construed as being included therein. Note that like components are denoted by like numerals in different drawings as of the configuration of the invention.

Figure 1:
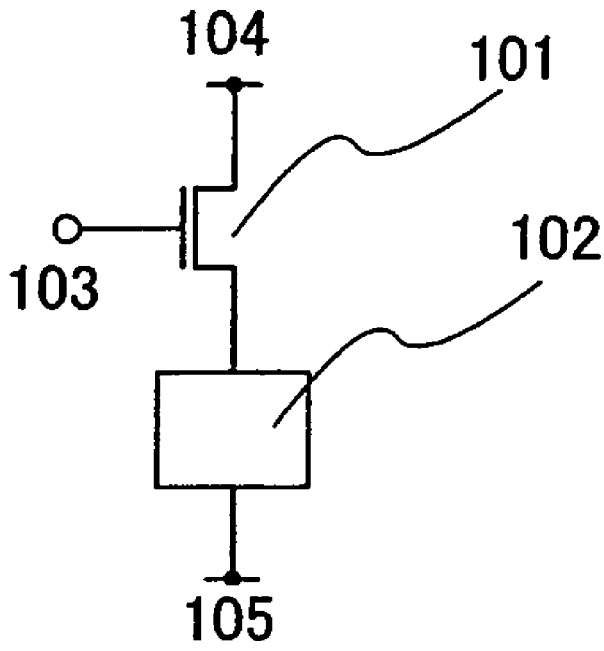
FIG. 1 is a circuit diagram showing light emission of an EL element.
Figure 2:
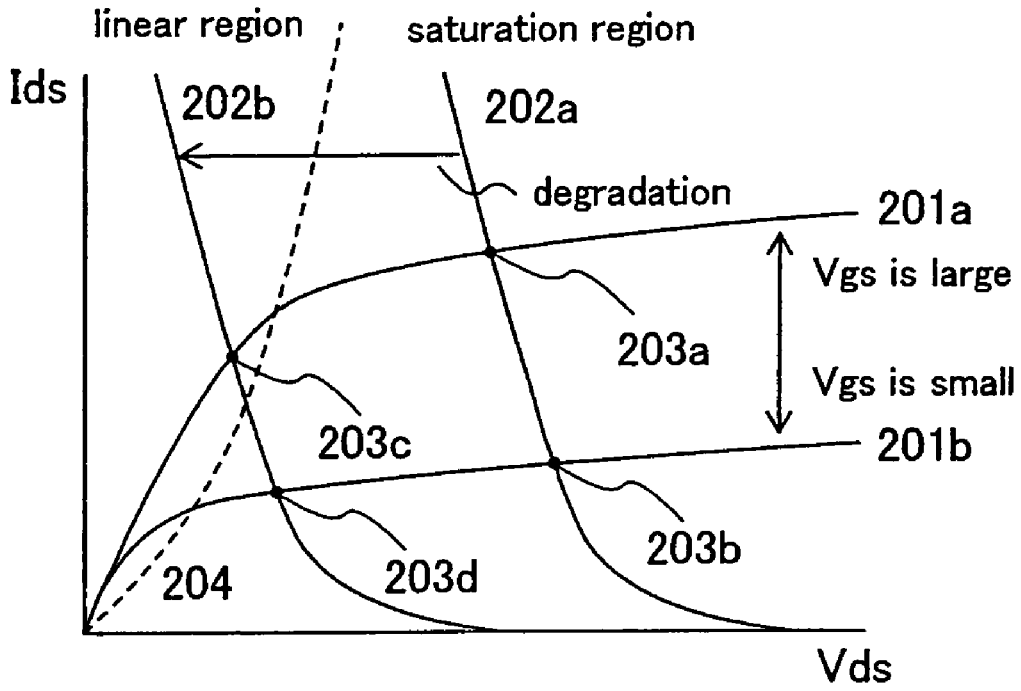
FIG. 2 is a load line diagram showing characteristics of the circuit in FIG. 1.
Figure 3:
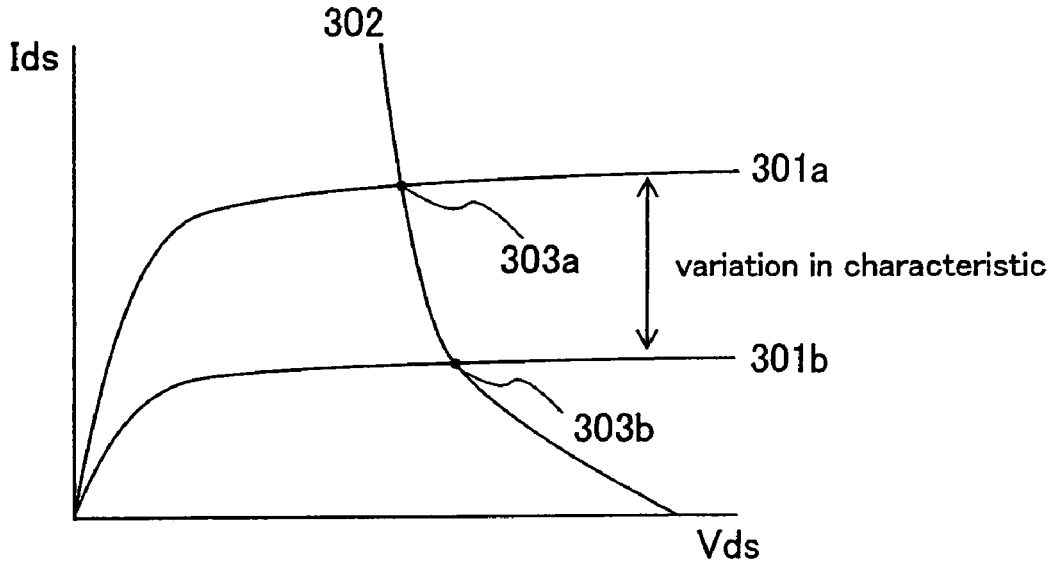
FIG. 3 is a load line diagram showing characteristics of the circuit in FIG. 1.
Figure 4:
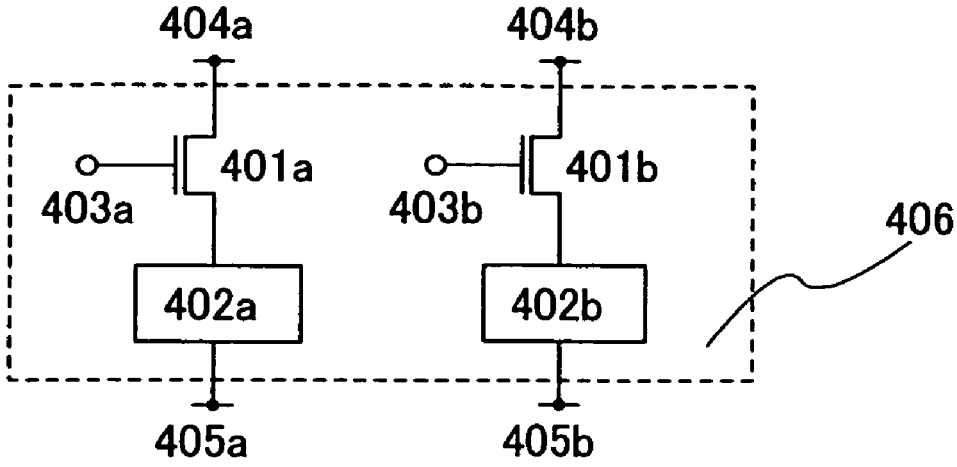
FIG. 4 is a diagram showing a configuration of the display device of the invention.

FIG. 4 shows an embodiment mode of the invention. A display device includes one or more of a pixel 406, and the pixel 406 comprises EL elements 402*a* and 402*b* respectively, driving TFTs 401*a* and 401*b* for driving the EL elements 402*a* and 402*b*, signal terminals 403*a* and 403*b* connected to gates of the driving TFTs 401*a* and 401*b* respectively, first power supply terminals 404*a* and 404*b* connected to first terminals of the driving TFTs 401*a* and 401*b* respectively, and second power supply terminals 405*a* and 405*b* connected to second terminals of the EL elements 402*a* and 402*b* respectively. Second terminals of the driving TFTs 401*a* and 401*b* are connected to first terminals of the EL elements 402*a* and 402*b* respectively.

The driving TFT 401*a* and the driving TFT 401*b* have different characteristics. By using TFTs of different characteristics, a display device can be operated favorably in both a high gray-scale and a low gray-scale. Characteristics of TFTs can be made different by making the size or shape of the TFTs different, making the kind of dopant or the amount of doping of the TFTs different, and making the number of TFTs connected in series or parallel different.

It should be noted that other elements may be provided between the gates of the driving TFTs 401*a* and 401*b* and the signal terminals 403*a* and 403*b* respectively, between the first terminals of the driving TFTs 401*a* and 401*b* and the first power supply terminals 404*a* and 404*b* respectively, between the second terminals of the EL elements 402*a* and 402*b* and the second power supply terminals 405*a* and 405*b* respectively, and between the second terminals of the driving TFTs 401*a* and 401*b* and the first terminals of the EL elements 402*a* and 402*b* respectively. For example, by providing switches between the first terminals of the driving TFTs 401*a* and 401*b* and the first power supply terminals 404*a* and 404*b* respectively, emission and non-emission of the EL elements 402*a* and 402*b* can be controlled regardless of the states of the signal terminals 403*a* and 403*b*.

The driving TFTs 401*a* and 401*b* may be an N-channel TFT or a P-channel TFT.

The EL elements 402*a* and 402*b*, the first power supply terminals 404*a* and 404*b*, and the second power supply terminals 405*a* and 405*b* can be common respectively, but may be separated. By separating them, operations in the high gray-scale and the low gray-scale can be controlled separately. For example, an element area of the EL element 402*a* is designed wide for displaying the high gray-scale and that of the EL element 402*b* is designed narrow for displaying the low gray-scale separately. An EL element of narrower area generally has higher resistance, and a smaller current flows in the lower gray-scale, therefore, potential of operation points of the EL elements can be close to each other in the high gray-scale and the low gray-scale. Each Vds of the driving TFTs 401*a* and 401*b* corresponds to the voltage that deducted the fall in voltage in the EL elements 402*a* and 402*b* from the difference between the first power supply terminals 404*a* and 404*b*, and the second power supply terminals 405*a* and 405*b*. When potential of the operation points of the EL elements are close to each other in the high gray-scale and the low gray-scale, Vds of the driving TFTs 401*a* and 401*b* can be close to each other. Typically, Ids of TFT tends to rise slightly when Vds rises even in a saturation region, which is an obstacle for an accurate luminance control. By controlling Vds so as to be close to each other in the high gray-scale and the low gray-scale, more accurate luminance control can be performed.

The signal terminals 403*a* and 403*b* are separated, however, they may be one common terminal as well.

An operation of the display panel of the invention is described with reference to FIG. 5.

Figure 5:
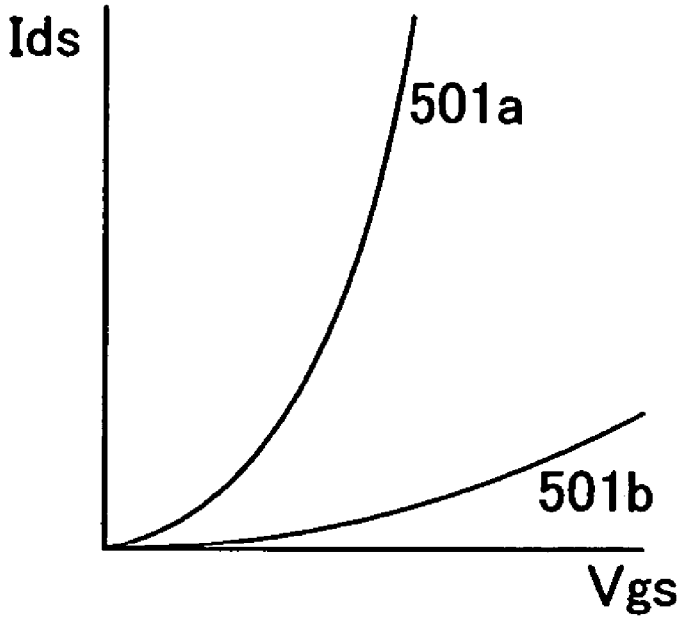
FIG. 5 is a diagram showing characteristics of a driving TFT.

FIG. 5 shows a relation between Vgs and Ids of the driving TFTs 401*a* and 401*b*. As an example, a high current capacity TFT is used as the driving TFT 401*a* and a low current capacity TFT is used as the driving TFT 401*b*. A characteristic line 501*a* corresponds to Vgs-Ids characteristic of the driving TFT 401*a* and the characteristic line 501*b* corresponds to Vgs-Ids characteristic of the driving TFT 401*b*. It should be noted that Ids flows into the EL elements 402*a* and 402*b* in FIG. 4.

In an EL element, current and luminance are in proportion generally. Therefore, a luminance can be controlled by controlling Ids. The luminance of a display device corresponds to a sum of the currents flowing into the EL elements 402*a* and 402*b*.

Each Vgs of the driving TFT 401*a* and the driving TFT 401*b* is controlled separately. Here, Vgs of the driving TFT 401*a* is referred to as Vgsa, and Vgs of the driving TFT 401*b* is referred to as Vgsb. The driving TFTs 401*a* and 401*b* controlled separately supply currents Idsa and Idsb into the EL elements 402*a* and 402*b* corresponding to Vgsa and Vgsb respectively. A current Idsa+Idsb determines the luminance of the display device.

In the high gray-scale of high luminance, Ids of the driving TFT 401*a* is made higher than that of the driving TFT 401*b*, while in the low gray-scale of low luminance, Ids of the driving TFT 401*b* is made higher than that of the driving TFT 401*a*.

Figure 6:
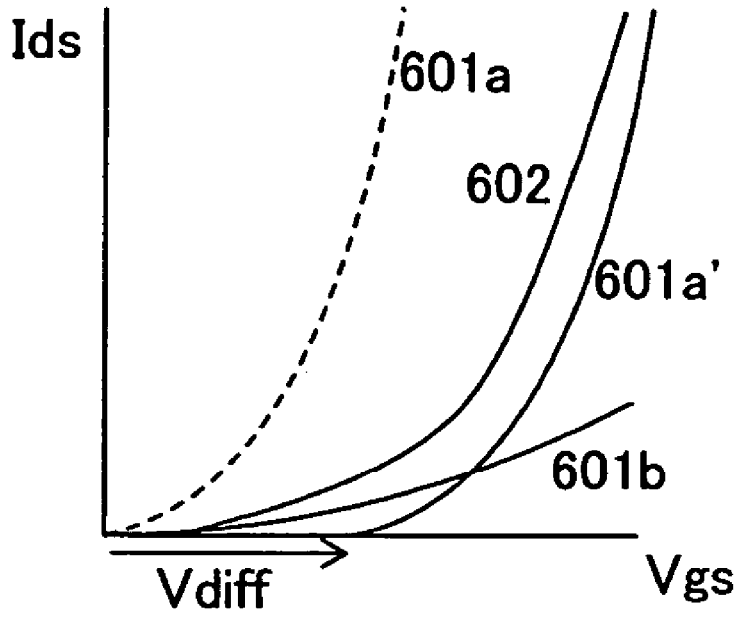
FIG. 6 is a diagram showing operations of the display device of the invention.

FIG. 6 shows an example where the gates of the driving TFTs 401*a* and 401*b* have different voltages. Vgsa and Vgsb are determined so as to satisfy the following formula.

$$Vgsa = Vgsb - Vdiff \quad \text{[Formula 1]}$$

A characteristic line 601*a*' shows the case where Vgsa is applied to the gate of the driving TFT 401*a* and a characteristic line 601*b* shows the case where Vgsb is applied to the gate of the driving TFT 401*b*. Note that the characteristic line 601*a*' corresponds to a characteristic line 601*a* in which Vgsb is applied to the gate of the driving TFT 401*a* is shifted by Vdiff.

A current Ids in a saturation region is expressed by the following formula when a drain current of the driving TFT 401*a* is Idsa' and a drain current of the driving TFT 401*b* is Idsb.

$$\begin{aligned} Idsa' &= \frac{Wa}{La}\mu aCa\frac{(Vgsa - Vtha)^2}{2} \\ &= \frac{Wa}{La}\mu aCa\frac{(Vgsb - Vdiff - Vtha)^2}{2} \\ Idsb &= \frac{Wb}{Lb}\mu bCb\frac{(Vgsb - Vthb)^2}{2} \end{aligned} \quad \text{[Formula 2]}$$

Here, Wa, Wb, La, Lb, μa, μb, Ca, Cb, Vtha, and Vthb are gate width, gate length, mobility, capacitance per unit area of an oxide film, and threshold voltage of the driving TFTs 401*a* and 401*b* respectively.

A sum Iel of the current flowing into the EL elements 402*a* and 402*b* can be expressed by the following formula.

$$Iel = Idsa' + Idsb \quad \text{[Formula 3]}$$
$$= \frac{Wa}{La}\mu aCa\frac{(Vgsb - Vdiff - Vtha)^2}{2} + \frac{Wb}{Lb}\mu bCb\frac{(Vgsb - Vthb)^2}{2}$$

Further, Iel can be expressed by a characteristic line 602 in FIG. 6. This Iel determines the luminance of a display device.

The driving TFT 401*a* has a higher current capacity than the driving TFT 401*b*. Idsa' is comparatively larger in a high gray-scale where a consumption current is large, while Idsb is comparatively larger in a low gray-scale where a consumption current is small and an effect of variation in characteristics of the driving TFTs is preferably small. By selectively using driving TFTs according to the gray-scale, a display device which is not largely affected by the degradations of the EL elements 402*a* and 402*b* and the variation in characteristics of the driving TFTs, and consumes less power can be provided.

Idsa' becomes almost zero when the formula |Vgsb−Vdiff−Vtha|=0 is satisfied, therefore, luminance of a display device is almost dependent on the current supplied by the driving TFT 401*b*. Further, as Vgsa and Vgsb get higher, a current supplied by the driving TFT 401*a* becomes larger than the current supplied by the driving TFT 401*b*. As described above, the current supplied by the driving TFT 401*b* is large in the low gray-scale and the current supplied by the driving TFT 401*a* is large in the high gray-scale.

Figure 7A:
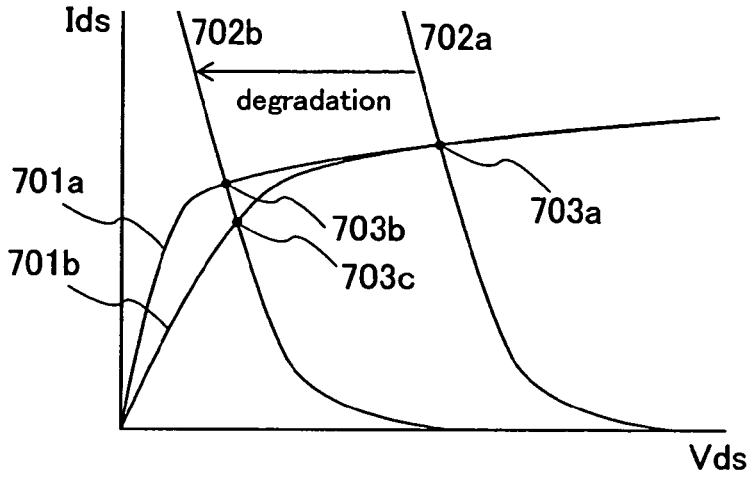
FIGS. 7A and 7B are load line diagrams showing operations of the display device of the invention.

An advantage of the case of using a high current capacity TFT in the high gray-scale is shown by load lines in FIG. 7A. When Vds-Ids characteristic in the case of using a high current capacity TFT as the driving TFT 401*a* is a characteristic line 701*a*, Vds-Ids characteristic in the case of using a low current capacity TFT is a characteristic line 701*b*. Further, V-I characteristic before the EL element 402*a* is degraded is a characteristic line 702*a* and V-I characteristic after degradation is a characteristic line 702*b*. Intersections of the characteristic lines 701*a* and 701*b*, and the characteristic lines 702*a* and 702*b* corresponds to operation points 703*a* to 703*c*. At this time, Vgs of a driving TFT is controlled so that Ids of the characteristic lines 701*a* and 701*b* become the same at the operation point 703*b*. In the high current capacity TFT, characteristic of current rises sharply in a linear region. As lower Vds enters a saturation region, the high current capacity TFT does not operate in a linear region easily even when the EL element 402*a* degrades and Vds is lowered. In FIG. 7A, an operation point 703*b* corresponds to the case of using a high current capacity TFT and an operation point 703*c* corresponds to the case of using a low current capacity TFT when the EL element 402*b* is degraded.

Figure 7B:
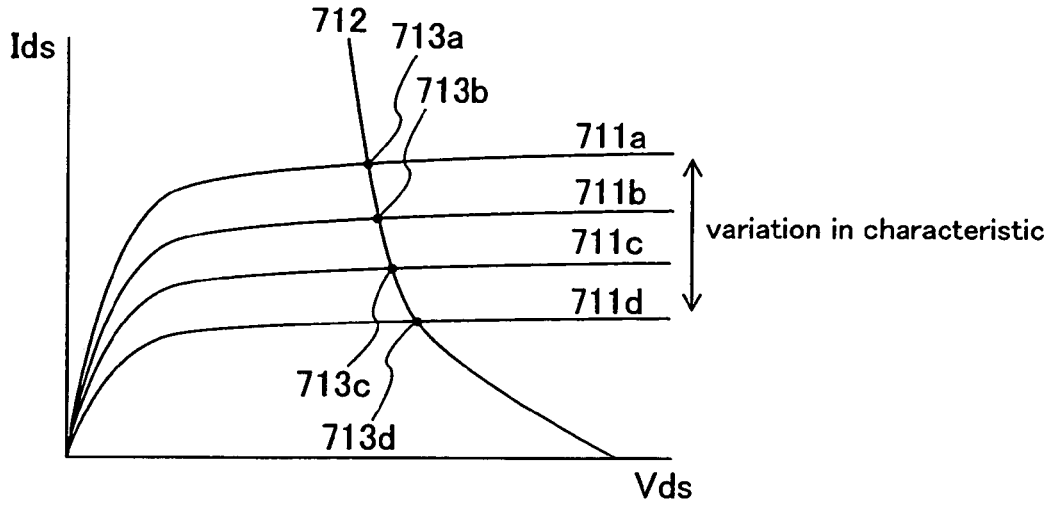

An advantage in the case of using a low current TFT in the low gray-scale is shown by a load line in FIG. 7B. When Vds-Ids characteristic in the case of using a high current capacity TFT as the driving TFT 401*b* varies in the region from a characteristic line 711*a* to a characteristic line 711*d*, Vds-Ids characteristic in the case of using a low current capacity TFT varies in the region from a characteristic line 711*b* to the characteristic line 711*c*, which is narrower than the case of using a high current TFT. Further, V-I characteristic of the EL element 402*b* corresponds to a characteristic line 712. Intersections of the characteristic lines 711*a* to 711*d* and the characteristic line 712 correspond to operation points 713*a* to 713*d*. The operation point varies in the case of using a high current capacity TFT in the region from 713*a* to 713*d*, while it varies in the region from the operation points 713*b* to 713*c* in the case of using a low current capacity TFT, which is narrower than the case of using a high current TFT.

A reason why the variation is narrower in the case of using a low current capacity TFT is described now. Ids of a TFT in a saturation region can be expressed by the following formula.

$$Ids = \frac{W}{L}\mu C\frac{(Vgs - Vth)^2}{2} \quad \text{[Formula 4]}$$

Here, W, L, μ, C, and Vth correspond to gate width, gate length, mobility, capacitance per unit area of an oxide film, and threshold voltage respectively. When W/L is small, current capacity is lowered. By the above formula, the lower the current capacity of the driving TFT 401*b* is, the higher Vgs is applied even with the same Ids. By applying higher Vgs, an effect of the variation in Vth to Ids can be small, which makes the variation in Ids small.

Vgs is high in high gray-scale, therefore, an effect of Vth is small. Thus, a high current TFT may be used as the driving TFT 401*a*. Further, Vgs is low in the low gray-scale, therefore, a driving TFT is easily operated in a saturation region. Thus, a low current capacity TFT may be used as the driving TFT 401*b*.

In this embodiment mode, the driving TFT 401*a* which provides a high current capacity is used as a power supply in the high gray-scale, while the driving TFT 401*b* which provides a low current capacity is used as a power supply in the low gray-scale. By selectively using the driving TFTs according to the gray-scale, a display device in which luminance is not easily reduced even when the EL elements 402*a* and 402*b* are degraded and which is not easily affected by the variation of the TFTs can be provided.

An additional voltage for the voltage fall caused by the increased resistance of the EL elements 402*a* and 402*b* in the case where the EL elements 402*a* and 402*b* are degraded is applied in advance between the first power supply terminals 404*a* and 404*b* and the second power supply terminals 405*a* and 405*b* besides the driving voltage of the EL elements 402*a* and 402*b* and the voltage for the driving TFTs 401*a* and 401*b* to reach a saturation region. In this manner, the driving TFTs 401*a* and 401*b* do not operate in a linear region even when Vds of the driving TFTs 401*a* and 401*b* are lowered by the increased voltage fall of the EL elements 402*a* and 402*b*. Thus, luminance is not reduced. However, by applying a voltage for the voltage fall caused by the increased resistance of the EL elements 402*a* and 402*b*, power consumption may be increased. In this embodiment mode, by mainly using a high current capacity TFT in the high gray-scale, lower Vds of the driving TFT is included in a saturation region. As the lower Vds is in a saturation region, degradations of the EL elements 402*a* and 402*b* do not have much effect even when the first power supply terminals 404*a* and 404*b* and the second power supply terminals 405*a* and 405*b* have small voltage between them. As described above, a display device which consumes less power, generates less heat, and of which TFTs are not degraded easily can be provided.

An example of a method for applying a potential difference Vdiff between Vgsa and Vgsb is described now. A capacitor having potential difference in each end is provided between a gate and signal terminals 403*a* and 403*b* of one or both of the driving TFT 401*a* and 401*b*. As a result, one or both of the gates of the driving TFTs 401*a* and 401*b* which is provided with a capacitor is applied a voltage which is a sum of the voltage of the signal terminals 403*a* and 403*b* and the potential difference between both ends of the capacitor. In this example, a potential difference Vdiff can be applied to the gates of the driving TFTs 401*a* and 401*b* by using a capacitor even when the signal terminals 403*a* and 403*b* are one terminal. Provided that the signal lines 403*a* and 403*b* are common, control of the driving TFTs 401*a* and 401*b* can be easy.

Embodiment Mode 2

Figure 8A:
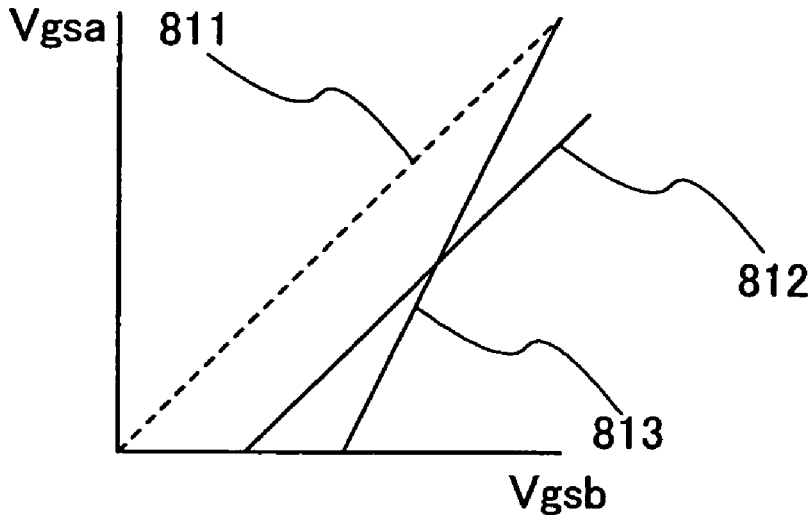
FIGS. 8A and 8B are diagrams showing operations of the display device of the invention.

An embodiment mode of the invention is described with reference to FIGS. 8A and 8B. In order to set Vgs of the driving TFTs 401*a* and 401*b* at different voltages, a voltage of the driving TFT 401*a* is shifted in Embodiment Mode 1. A relation between Vgs of the driving TFT 401*a* and Vgs of the driving TFT 401*b* is shown in FIG. 8A. Here, Vgs of the driving TFT 401*a* is Vgsa and Vgs of the driving TFT 401*b* is Vgsb. When a characteristic line 811 shows the case of applying the same voltage as Vgsa and Vgsb, it corresponds to a characteristic line 812 in Embodiment Mode 1. In this embodiment mode, a different method for setting a voltage from Embodiment Mode 1 is described.

Vgsa is set so as to be low relatively to Vgsb in low gray-scale, while Vgsb is set so as to be close to Vgsa in higher gray-scale. A voltage setting in this embodiment mode is shown by a characteristic line 813.

Figure 8B:
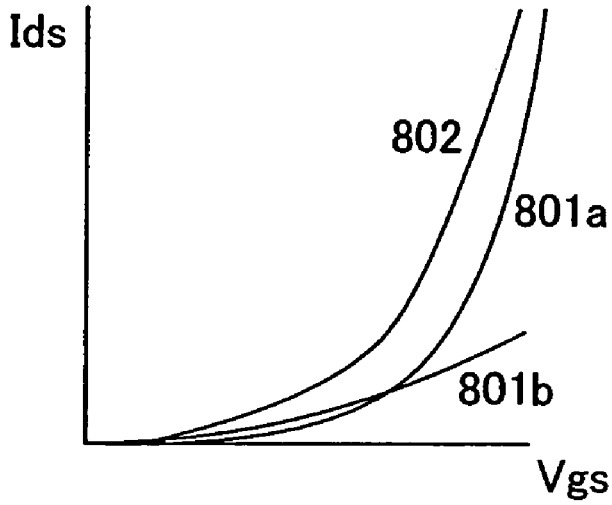

FIG. 8B shows a Vgs-Ids characteristic line 801 a of the driving TFT 401*a* which is applied the aforementioned Vgs, a Vgs-Ids characteristic line 801*b* of the driving TFT 401*b*, and a characteristic line 802 of a sum of the current of the driving TFTs 401*a* and 401*b*. Ids of the driving TFT 401*b* becomes larger in the low gray-scale while Ids of the driving TFT 401*a* becomes larger in the high gray-scale. A display device in which luminance is not easily reduced even when the EL elements 401*a* and 401*b* are degraded and which is not easily affected by variation of the driving TFTs 401*a* and 401*b* can be provided.

It is preferable that the driving TFTs 401*a* and 401*b* operate in a saturation region with lower Vds so that luminarice is not changed due to the degradation of the EL elements 402*a* and 402*b*. At this time, a saturation region begins from Vds that is equal to Vgs, therefore, Vgs is preferred to be as low as possible in order to avoid an effect of a degradation of the EL elements 402*a* and 402*b*. Vgs changes according to the gray-scale and becomes a maximal value in the highest gray-scale. That is to say, it is efficient that Vgs of the driving TFTs 401*a* and 401*b* in the highest gray-scale be as low as possible. In order to make Vgs the lowest while making the currents of the driving TFTs 401*a* and 401*b* the largest in the highest gray-scale, Vgs in the highest gray-scale are set to be the same.

According to this embodiment mode, an effect of variation of TFTs can be small in the low gray-scale, and an effect of a degradation of an EL element can be small in the high gray-scale. Further, Vgs can be made as low as possible in the gray-scale which is affected the most by the degradation, therefore, the effect of the degradation can be even smaller.

Embodiment Mode 3

An embodiment mode of the invention is described with reference to FIG. 9. Vgs of the driving TFTs 401*a* and 401*b* are set at different voltages in Embodiment Modes 1 and 2. In this embodiment mode, the driving TFT 401*a* can be mainly used in the high gray-scale and the driving TFT 401*b* can be mainly used in the low gray-scale even when Vgs of the driving TFTs 401*a* and 401*b* are the same.

It is assumed that a current supplied from the driving TFT 401*a* is Idsa and a current supplied from the driving TFTs 401*b* is Idsb. In this embodiment mode, a current that deducted a constant current Idiff from Idsa is supplied to the EL element 402*a*. A current Iel supplied to the EL elements 402*a* and 402*b* can be expressed by the following formula.

$$Iel=Idsa-Idiff+Idsb \ldots (Idsa>Idiff)\ Iel=Ids \ldots (Idsa\leqq Idiff) \quad \text{[Formula 5]}$$

Figure 9:
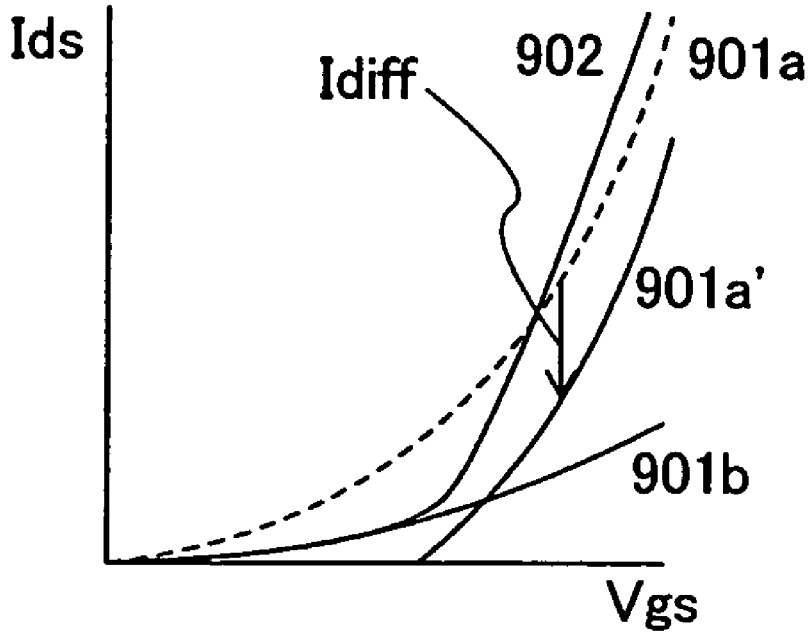
FIG. 9 is a diagram showing an operation of the display device of the invention.

FIG. 9 shows a Vgs-Ids characteristic line 901*a* of the driving TFT 401*a* which is applied Vgs, a characteristic line 901*a*' that deducted Idiff from the characteristic line 901*a*, a Vgs-Ids characteristic line 901*b* of the driving TFT 401*b*, and a characteristic line 902 which is a sum of the characteristic line 901*a*' and the characteristic line 901*b*. Here, the characteristic line 901*a* corresponds to Idsa, the characteristic line 901*b* corresponds to Idsb, and the characteristic line 902 corresponds to Iel. Ids of the driving TFT 401*b* is comparatively larger in the low gray-scale, while Ids of the driving TFT 401*a* is comparatively larger in the high gray-scale. Thus, a display device in which a luminance is not easily reduced when the EL elements 402*a* and 402*b* are degraded and which is not easily affected by a variation in characteristics of the driving TFTs 401*a* and 401*b* can be provided.

Unlike Embodiment Mode 1 in which Vgs of the driving TFT 401*a* is shifted and Embodiment Mode 2 in which Vgs of the driving TFTs 401*a* and 401*b* are controlled separately, Vgs of the driving TFTs 401*a* and 401*b* are equal in this embodiment mode. When Vgs are equal, the signal terminals 403*a* and 403*b* can be common and a gray-scale can be controlled simply.

Embodiment Mode 4

In Embodiment Modes 1 to 3, three or more driving TFTs may be used. In the case of using three driving TFTs for example, a gray-scale is divided into three levels: low gray-scale, middle gray-scale, and high gray-scale, then a driving TFT having an appropriate characteristic is provided to each level. By using three or more driving TFTs, an effect of degradation and variation can be suppressed in the case of a light emission at an extremely low luminance and a light emission at a high luminance.

In the case of a display device which is used both in darkness and brightness such as a portable device, a light emission at an extremely low luminance is required in darkness and a light emission at high luminance is required in brightness. In the case of using three driving TFTs for example, two driving TFTs are used at each of the extremely low luminance and the high luminance. In the light emission at an extremely low luminance, a first driving TFT which provides a low current capacity and a second driving TFT which provides a middle current capacity are used. The first driving TFT is used in a lower gray-scale at the extremely low luminance, while the second driving TFT is used in a higher gray-scale therein. Further, in the light emission at a high luminance, the second driving TFT which provides a middle current capacity and a third driving TFT which provides a high current capacity are used. The second driving TFT is used in a lower gray-scale in the high gray-scale, while the third driving TFT is used in a higher gray-scale at the high luminance. At the extremely low luminance, a power supply voltage can be low in order to maintain an operation in a saturation region even when Vds is low, thus a power consumption can be reduced. By using three or more driving TFTs as described above, an optimal drive regardless of a luminance can be produced. It is needless to say that three or more driving TFTs may be used at the same time in a single luminance level.

EMBODIMENT

An embodiment of the invention is described now.

Embodiment 1

Figure 10:
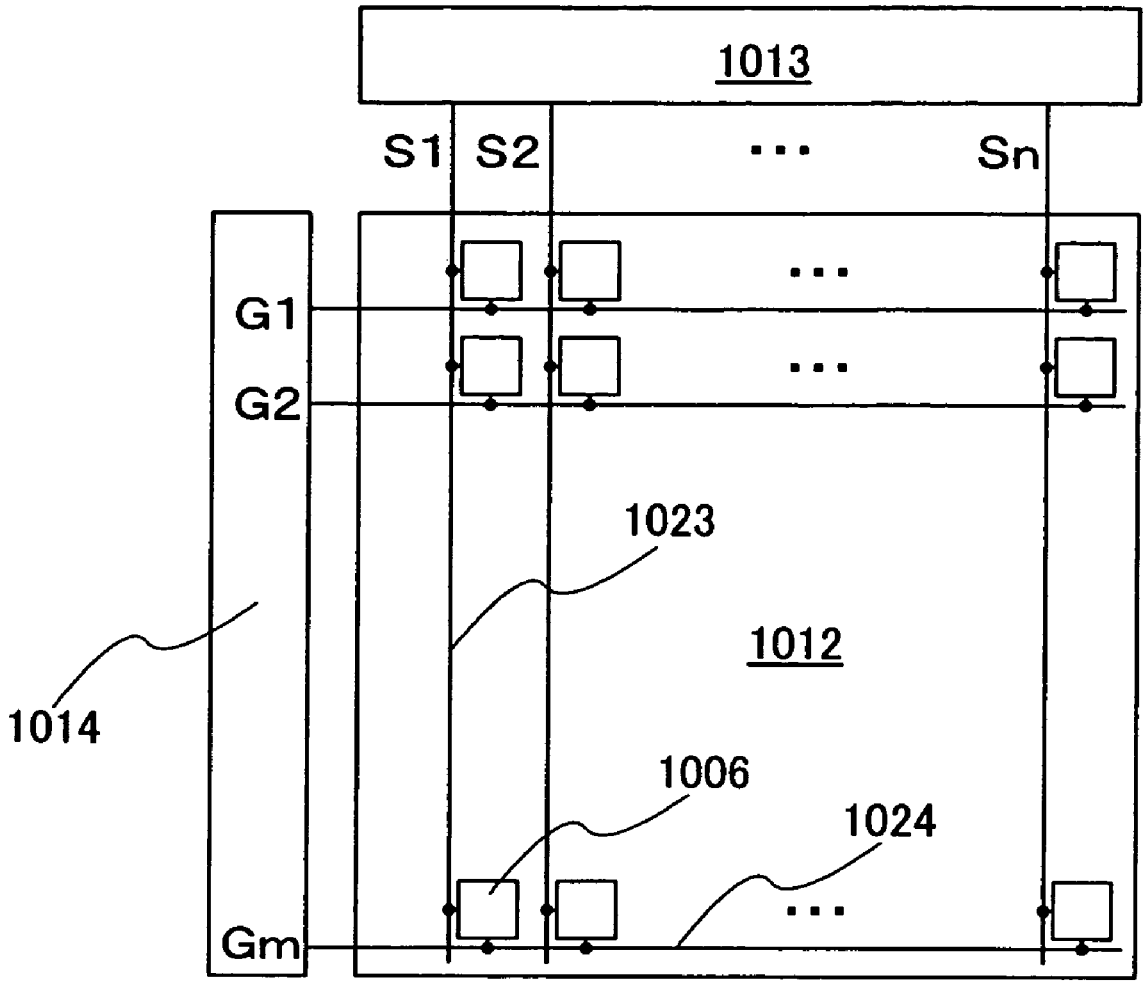
FIG. 10 is a diagram showing an embodiment of the invention.

In this embodiment, a structure of the display device described in Embodiment Mode 1 is described. FIG. 10 is a structure of the display device. The display device comprises a pixel portion 1012 in which a plurality of pixels 1006 are arranged in matrix of m rows and n columns, and a signal driver circuit 1013 and a row selection driver circuit 1014 in the periphery of the pixel portion 1012. Each signal line 1023 denoted as S1 to Sn is connected to the plurality of pixels 1006 according to the columns and also connected to the signal driver circuit 1013. A row selection line 1024 denoted as G1 to Gm is connected to the plurality of pixels 1006 according to the rows, and also connected to the row selection driver circuit 1014. The display device comprises a power supply line and the like other than the aforementioned components, however, they are not shown in FIG. 10.

Figure 11:
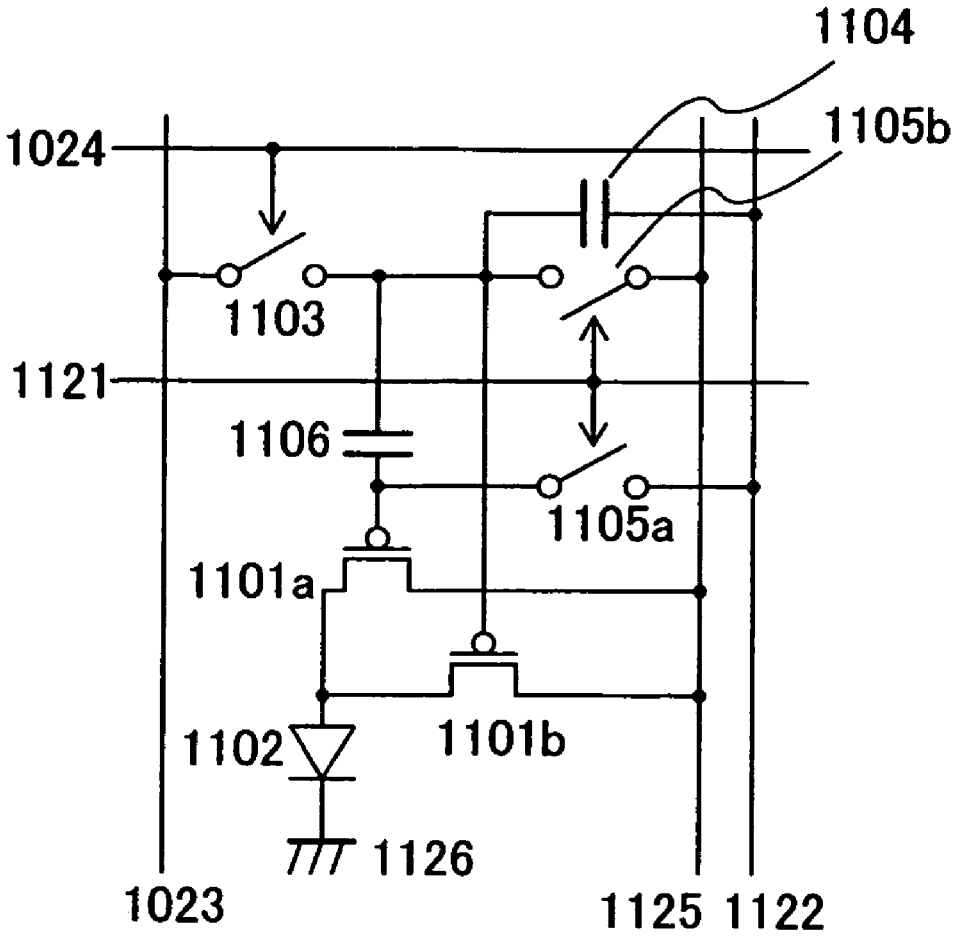
FIG. 11 is a diagram showing an embodiment of the invention.

FIG. 11 shows a configuration of the pixel 1006. The pixel 1006 comprises driving TFTs 1101*a* and 1101*b*, an EL element 1102, a write switch 1103, a first capacitor (pixel capacitor) 1104, a voltage shift capacitor switches 1105*a* and 1105*b*, and a second capacitor (voltage shift capacitor) 1106. A second terminal of the EL element 1102 is connected to a cathode 1126, drains of the driving TFTs 1101*a* and 1101*b* are connected to a first terminal of the EL element 1102, and the sources thereof are connected to an anode 1125. The gate of the driving TFT 1101*a* is connected to a second terminal of the voltage shift capacitor 1106 and also connected to a wiring (pixel capacitor line) 1122 via the voltage shift capacitor switch 1105*a*. The gate of the driving TFT 1101*b* and a first terminal of the voltage shift capacitor 1106 are connected to a signal line 1023 via the write switch 1103 and also connected to the anode 1125 via the voltage shift capacitor switch 1105*b*, and further connected to a first terminal of the pixel capacitor 1104. A second terminal of the pixel capacitor 1104 is connected to the pixel capacitor line 1122. The write switch 1103 is controlled by the scan line (row selection line) 1024 and the voltage shift capacitor switches 1105*a* and 1105*b* are controlled by a wiring (voltage shift capacitor control signal line) 1121.

An operation of the pixel 1006 in this embodiment is described now.

An arbitrary voltage Vdiff is applied to the voltage shift capacitor 1106. It should be noted that the voltage Vdiff is a difference between Vgs of the driving TFT 1101*a* and that of the driving TFT 1101*b*. A potential difference Vdiff is supplied to the anode 1125 and the pixel capacitor line 1122 and the voltage shift capacitor switches 1105*a* and 1105*b* are turned ON by the voltage shift capacitor control signal line 1121. After a charge corresponding to a voltage Vdiff is charged in the voltage shift capacitor 1106, the voltage shift capacitor switches 1105*a* and 1105*b* are turned OFF by the voltage shift capacitor control signal line 1121. By the aforementioned operation, a voltage difference Vdiff can be applied to both ends of the voltage shift capacitor 1106. It should be noted that the write switch 1103 is preferably OFF during the aforementioned operation, however, the invention is not limited to this.

The write switch 1103 is turned ON by the row selection line 1024 while the potential difference Vdiff is applied to both ends of the voltage shift capacitor 1106. At this time, voltage Vsignal which is appropriate for a luminance of the EL element 1102 is applied to the signal line 1023. After a first terminal of the pixel capacitor 1104 reaches Vsignal, the write switch 1103 is turned OFF by the row selection line 1024. By the aforementioned operation, a gate of the driving TFT 1101*b* is applied Vsignal and a gate of the driving TFT 1101*a* is applied Vsignal−Vdiff.

By the aforementioned operation, the EL element 1102 emits light. As characteristics of the driving TFT 1101*a* and the driving TFT 1101*b* are different and Vgs of the driving TFT 1101*a* and that of the driving TFT 1101*b* are different, a display device having the characteristics described in Embodiment Mode 1 can be provided.

Further, different Vgs can be supplied to the driving TFTs 1101*a* and 1101*b* rather simply.

A reason why a potential difference between the anode 1125 and the pixel capacitor line 1122 is used in order that the voltage shift capacitor 1106 may have a potential difference is described now. The anode 1125 is required to be controlled in accordance with a characteristic of the EL element 1102. Further, Vdiff is also required to be controlled in accordance with characteristics of the driving TFTs 1101*a* and 1101*b* and of the EL element 1102. A potential of the pixel capacitor line 1122, however, is generally arbitrary and may be set at an appropriate potential and can be determined in accordance with the anode 1125 and Vdiff.

Embodiment 2

Figure 12:
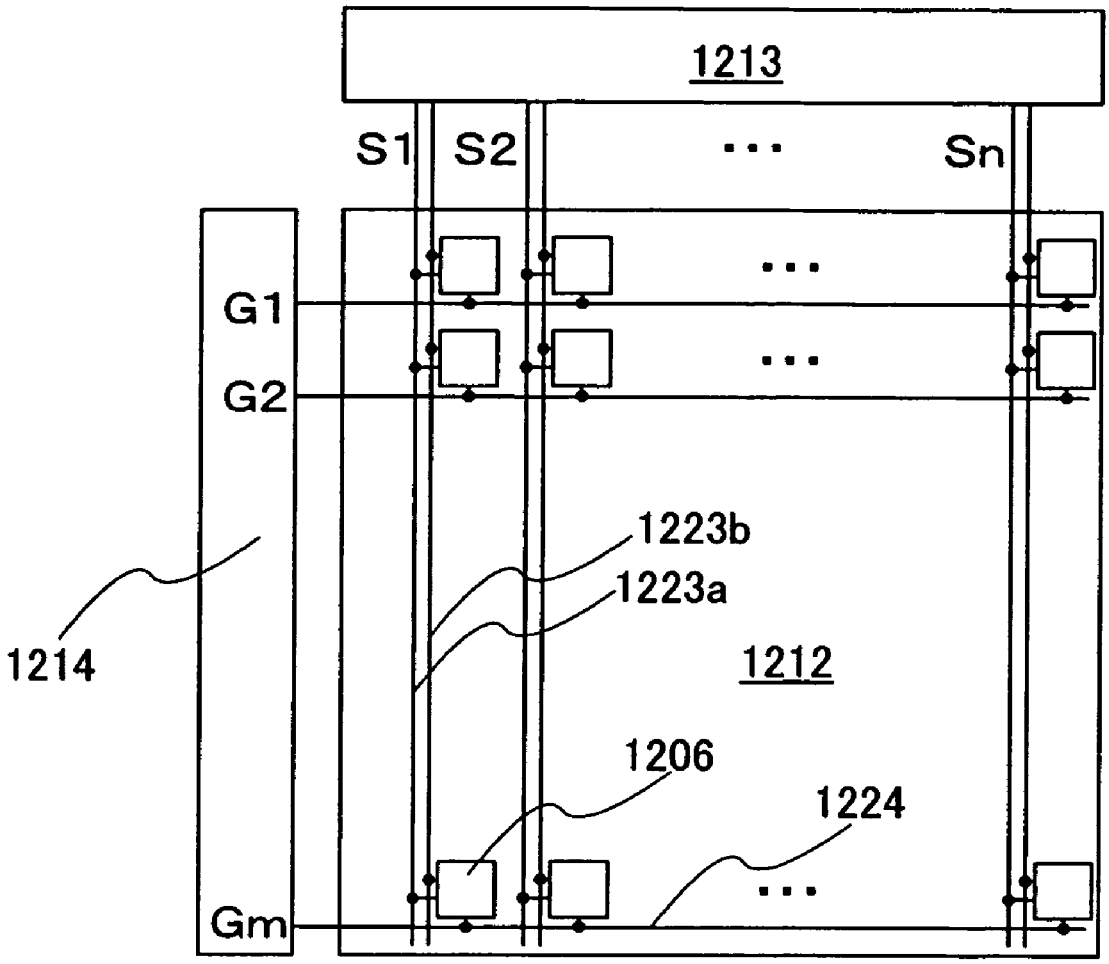
FIG. 12 is a diagram showing an embodiment of the invention.

In this embodiment, a structure of the display device described in Embodiment Mode 2 is described. FIG. 12 shows an example of a structure of the display device. The display device comprises a pixel portion 1212 in which a plurality of pixels 1206 are arranged in matrix of m rows and n columns, and a signal driver circuit 1213 and a row selection driver circuit 1214 in the periphery of the pixel portion 1212. Signal lines 1223*a* and 1223*b* denoted as S1 to Sn are connected to the plurality of pixels 1206 according to the columns and also connected to the signal driver circuit 1213. A row selection line 1224 denoted as G1 to Gm is connected to the pixel 1206 according to the rows, and also connected to the row selection driver circuit 1214. The display device comprises a power supply line and the like other than the aforementioned components, however, they are not shown in FIG. 12.

Figure 13:
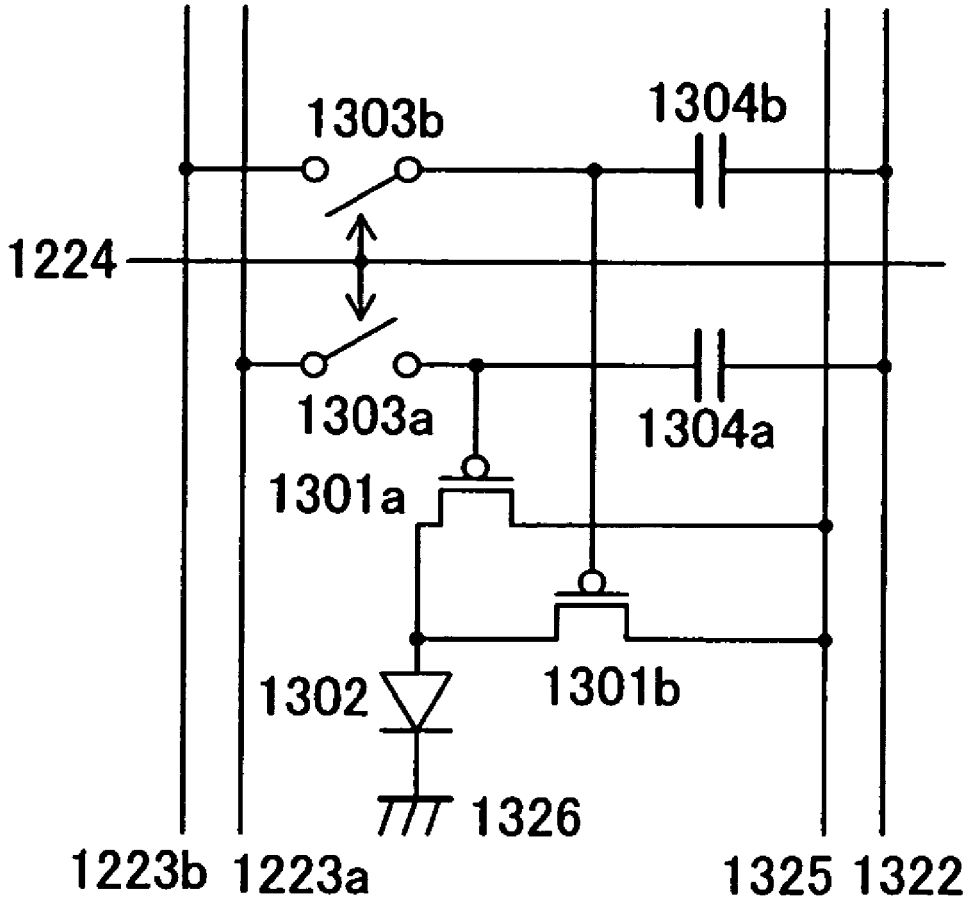
FIG. 13 is a diagram showing an embodiment of the invention.

FIG. 13 shows an example of a configuration of the pixel 1206. The pixel 1206 comprises driving TFTs 1301*a* and 1301*b*, an EL element 1302, write switches 1303*a* and 1303*b*, and pixel capacitors 1304*a* and 1304*b*. A second terminal of the EL element 1302 is connected to a cathode 1326, drains of the driving TFTs 1301*a* and 1301*b* are connected to a first terminal of the EL element 1302, sources thereof are connected to an anode 1325. Gates of the driving TFTs 1301*a* and 1301*b* are connected to first terminals of the pixel capacitors 1304*a* and 1304*b* respectively, and also connected to signal lines 1223*a* and 1223*b* respectively via write switches 1303*a* and 1303*b* respectively. Second terminals of the pixel capacitors 1304*a* and 1304*b* are connected to a pixel capacitor line 1322. The write switches 1303*a* and 1303*b* are controlled by the row selection line 1224.

An operation of the pixel 1206 is described now.

The write switches 1303*a* and 1303*b* are turned ON by the row selection line 1224. At this time, the signal lines 1223*a* and 1223*b* are applied voltages Vsignala and Vsignalb corresponding to a luminance of the EL element 1302. Vsignala and Vsignalb are set at different voltages here. After first terminals of the pixel capacitors 1304*a* and 1304*b* reach Vsignala and Vsignalb, the write switches 1303*a* and 1303*b* are turned OFF by the row selection line 1224. By the aforementioned operation, gates of the driving TFTs 1301*a* and 1301*b* are applied Vsignala and Vsignalb.

By the aforementioned operation, the EL element 1302 emits light. As characteristics of the driving TFTs 1301*a* and 1301*b* are different and Vgs of the driving TFT 1301*a* and that of the driving TFT 1301*b* are different, a display device having the characteristics described in Embodiment Mode 2 can be provided.

Further, Vgs of the driving TFT 1301*a* and that of the driving TFT 1301*b* can be set separately in accordance with a gray-scale, therefore, it is flexibly controlled. Moreover, a reliability can be enhanced because of a simple configuration.

Embodiment 3

In this embodiment, a structure of the display device described in Embodiment Mode 3 is described. A structure of the display device is described in Embodiment 1 with reference to FIG. 10. Note that a configuration of the pixel 1006 is different here from Embodiment 1.

Figure 14:
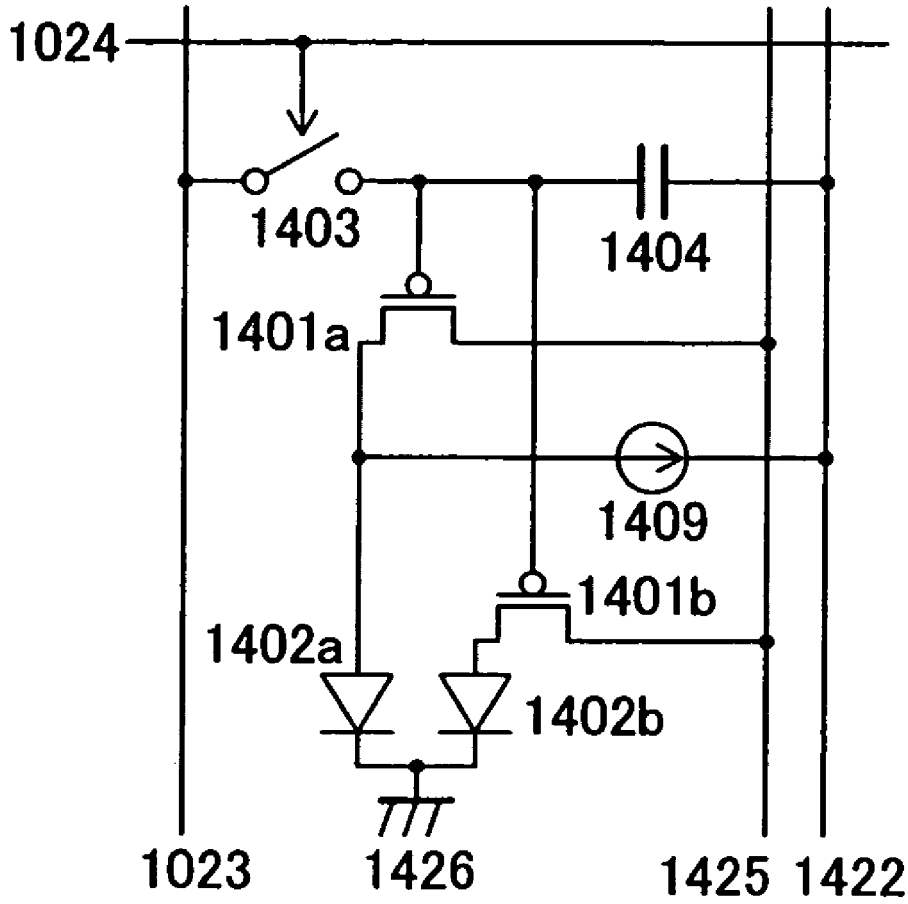
FIG. 14 is a diagram showing an embodiment of the invention.

FIG. 14 shows a configuration of the pixel 1006. The pixel 1006 comprises driving TFTs 1401*a* and 1401*b*, EL elements 1402*a* and 1402*b*, a write switch 1403, and a pixel capacitor 1404. Second terminals of the EL elements 1402*a* and 1402*b* are connected to a cathode 1426, drains of the driving TFTs 1401*a* and 1401*b* are connected to first terminals of the EL elements 1402*a* and 1402*b* respectively, and sources thereof are connected to an anode 1425. The first terminal of the EL element 1402*a* is also connected to a current source 1409. The current source 1409 is connected to a pixel capacitor line 1422, however, the invention is not limited to this. Gates of the driving TFTs 1401*a* and 1401*b* are connected to a first terminal of a pixel capacitor 1404 and also connected to a signal line 1023 via a write switch 1403. A second terminal of the pixel capacitor 1404 is connected to the pixel capacitor line 1422. The write switch 1403 is controlled by a row selection line 1024.

An operation of the pixel 1006 in this embodiment is described now.

The write switch 1403 is turned ON by the row selection line 1024. At this time, a voltage Vsignal which is appropriate for a luminance of the EL elements 1402*a* and 1402*b* is applied to the signal line 1023. After the first terminal of the pixel capacitor 1404 reaches Vsignal, the write switch 1403 is turned OFF by the row selection line 1024. By the aforementioned operation, gates of the driving TFTs 1401*a* and 1401*b* are applied Vsignal.

By the aforementioned operation, the EL elements 1402*a* and 1402*b* emit light. As characteristics of the driving TFTs 1401*a* and 1401*b* are different and a current supply to the EL element 1402*a* is decreased due to the current source 1409 connected to the drain of the driving TFT 1401*a*, a display device having the characteristics described in Embodiment Mode 3 can be provided.

Further, the driving TFTs 1401*a* and 1401*b* can be used separately in a high gray-scale and a low gray-scale rather simply.

The current source 1409 can be realized easily by using a TFT. By setting Vgs of a TFT so as to operate in a saturation region, a current can be reduced regardless of a drain voltage of the driving TFT 1401*a*. Further, the drain voltage is lowered when a current supply to the driving TFT 1401*a* is small, and a TFT of the current source 1409 operates in a linear region, thus a current to be reduced itself becomes small.

A capacitor line and an anode may be common in Embodiments 2 and 3. Further, three or more driving TFTs may be used in Embodiments 1 to 3.

Embodiment 4

The display device of the invention can be used for a variety of applications. In this embodiment, examples of electronic devices that the invention can be applied to are described.

Such electronic devices include a portable information terminal (an electronic book, a mobile computer, a portable phone and the like), a video camera, a digital camera, a personal computer, a television and the like. Examples of the aforementioned electronic devices are shown in FIGS. 15A to 15F.

Figure 15A:
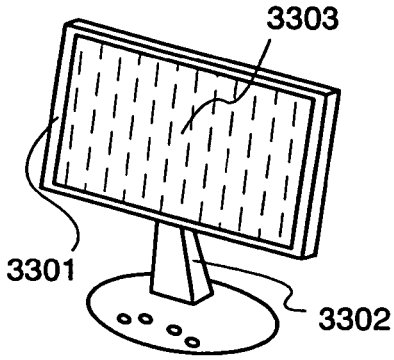
FIGS. 15A to 15F are examples of electronic devices to which the invention is applicable.

FIG. 15A illustrates an EL display including a housing 3301, a support base 3302, a display portion 3303 and the like. The display device of the invention can be used in the display portion 3303.

Figure 15B:
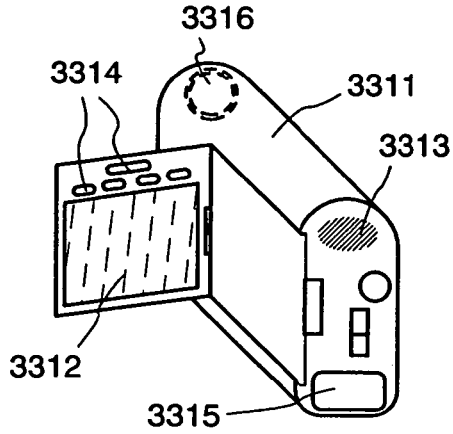

FIG. 15B illustrates a video camera including a body 3311, a display portion 3312, an audio input portion 3313, operation switches 3314, a battery 3315, an image receiving portion 3316 and the like. The display device of the invention can be used in the display portion 3312.

Figure 15C:
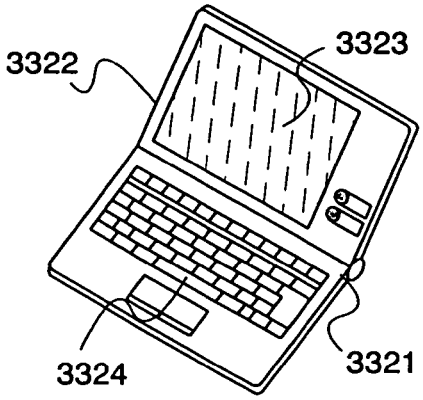

FIG. 15C illustrates a personal computer including a body 3321, a housing 3322, a display portion 3323, a keyboard 3324 and the like. The display device of the invention can be used in the display portion 3323.

Figure 15D:
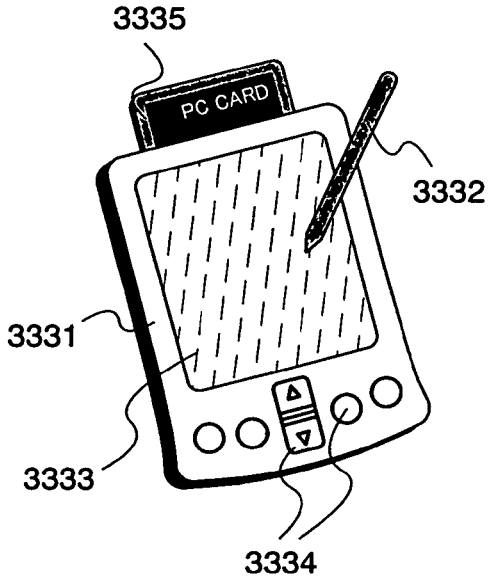

FIG. 15D illustrates a portable information terminal including a body 3331, a stylus 3332, a display portion 3333, operation buttons 3334, an external interface 3335 and the like. The display device of the invention can be used in the display portion 3333.

Figure 15E:
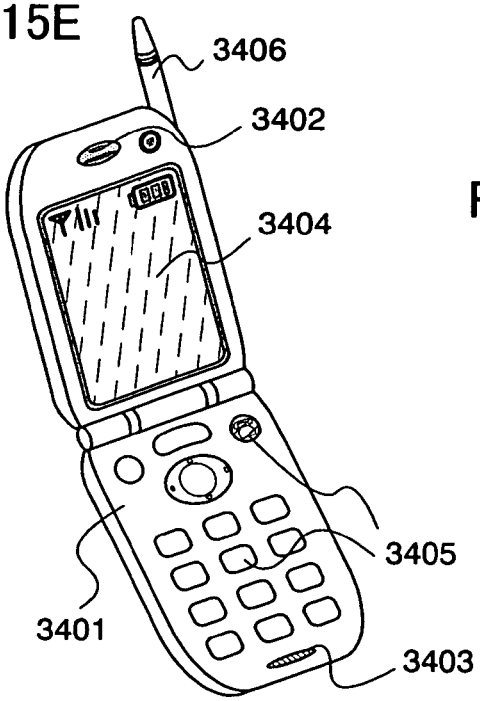

FIG. 15E illustrates a portable phone including a body 3401, an audio output portion 3402, an audio input portion 3403, a display portion 3404, operation switches 3405, an antenna 3406 and the like. The display device of the invention can be used in the display portion 3404.

Figure 15F:
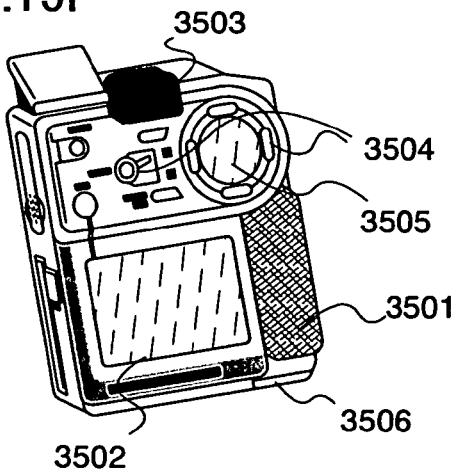

FIG. 15F illustrates a digital camera including a body 3501, a display portion A 3502, an eyepiece portion 3503, operation switches 3504, a display portion B3505, a battery 3506 and the like. The display device of the invention can be used in the display portions A3502 and B3505.

As described above, an application range of the invention is quite wide, and the invention can be applied to a variety of fields of electronic devices.

What is claimed is:

1. A display device comprising:

a first signal line;

a second signal line;

a scan line;

a light emitting element;

a first transistor connected to the first signal line and the scan line;

a first driving transistor of which a gate electrode is connected to the first transistor, a drain electrode of the first driving transistor being connected to the light emitting element and a source electrode of the first driving transistor being connected to an anode;

a second transistor connected to the second signal line and the scan line; and a second driving transistor of which a gate electrode is connected to the second transistor, a drain electrode of the second driving transistor being connected to the light emitting element and a source electrode of the second driving transistor being connected to the anode.

2. The display device according to claim 1, further comprising a unit for selecting driving transistors connected to the light emitting element in accordance with a luminance of the light emitting element.

3. The display device according to claim 1, wherein the display device is used for an electronic device selected from the group consisting of an EL display, a video camera, a personal computer, a portable information terminal, a portable phone, and a digital camera.

4. A display device comprising:

a first signal line;

a second signal line;

a scan line;

a light emitting element;

a power supply line;

a first transistor connected to the first signal line and the scan line;

a first capacitor connected to the first transistor and the power supply line;

a first driving transistor of which a gate electrode is connected to the first capacitor, a drain electrode of the first driving transistor being connected to the light emitting element and a source electrode of the first driving transistor being connected to an anode;

a second transistor connected to the second signal line and the scan line;

a second capacitor connected to the second transistor and the power supply line; and a second driving transistor of which a gate electrode is connected to the second capacitor, a drain electrode of the second driving transistor being connected to the light emitting element and a source electrode of the second driving transistor being connected to the anode.

5. The display device according to claim 4, further comprising a unit for selecting driving transistors connected to the light emitting element in accordance with a luminance of the light emitting element.

6. The display device according to claim 4, wherein the display device is used for an electronic device selected from the group consisting of an EL display, a video camera, a personal computer, a portable information terminal, a portable phone, and a digital camera.

7. A display device comprising:

a first signal line;

a second signal line;

a scan line;

a light emitting element;

a first transistor connected to the first signal line and the scan line;

a first driving transistor of which a gate electrode is connected to the first transistor, a drain electrode of the first driving transistor being connected to the light emitting element and a source electrode of the first driving transistor being connected to an anode;

a second transistor connected to the second signal line and the scan line; and a second driving transistor of which a gate electrode is connected to the second transistor, a drain electrode of the second driving transistor being connected to the light emitting element and a source electrode of the second driving transistor being connected to the anode, wherein the first driving transistor and the second driving transistor have different current capacities.

8. The display device according to claim 7, wherein the first driving transistor has a higher current capacity than the second driving transistor and used for a high gray-scale display.

9. The display device according to claim 7, wherein the second driving transistor has a lower current capacity than the first driving transistor and used for a low gray-scale display.

10. The display device according to claim 7, further comprising a unit for selecting driving transistors connected to the light emitting element in accordance with a luminance of the light emitting element.

11. The display device according to claim 7, wherein the display device is used for an electronic device selected from the group consisting of an EL display, a video camera, a personal computer, a portable information terminal, a portable phone, and a digital camera.

12. A display device comprising:

a first signal line;

a second signal line;

a scan line;

a light emitting element;

a power supply line;

a first transistor connected to the first signal line and the scan line;

a first capacitor connected to the first transistor and the power supply line;

a first driving transistor of which a gate electrode is connected to the first capacitor, a drain electrode of the first driving transistor being connected to the light emitting element and a source electrode of the first driving transistor being connected to an anode;

a second transistor connected to the second signal line and the scan line;

a second capacitor connected to the second transistor and the power supply line; and a second driving transistor of which a gate electrode is connected to the second capacitor, a drain electrode of the second driving transistor being connected to the light emitting element and a source electrode of the second driving transistor being connected to the anode, wherein the first driving transistor and the second driving transistor have different current capacities.

13. The display device according to claim 12, wherein the first driving transistor has a higher current capacity than the second driving transistor and used for a high gray-scale display.

14. The display device according to claim 12, wherein the second driving transistor has a lower current capacity than the first driving transistor and used for a low gray-scale display.

15. The display device according to claim 12, further comprising a unit for driving transistors connected to the light emitting element in accordance with a luminance of the light emitting element.

16. The display device according to claim 12, wherein the display device is used for an electronic device selected from the group consisting of an EL display, a video camera, a personal computer, a portable information terminal, a portable phone, and a digital camera.

17. A display device comprising:

a first signal line;

a second signal line;

a scan line;

a light emitting element;

a first transistor connected to the first signal line and the scan line;

a first driving transistor of which a gate electrode is connected to the first transistor, a drain electrode of the first driving transistor being connected to the light emitting element and a source electrode of the first driving transistor being connected to an anode;

a second transistor connected to the second signal line and the scan line; and a second driving transistor of which a gate electrode is connected to the second transistor, a drain electrode of the second driving transistor being connected to the light emitting element and a source electrode of the second driving transistor being connected to the anode, wherein a voltage between a gate and a drain of the first driving transistor and a voltage between a gate and a drain of the second driving transistor are different.

18. The display device according to claim 17, further comprising a unit for driving transistors connected to the light emitting element in accordance with a luminance of the light emitting element.

19. The display device according to claim 17, wherein the display device is used for an electronic device selected from the group consisting of an EL display, a video camera, a personal computer, a portable information terminal, a portable phone, and a digital camera.

20. A display device comprising:

a first signal line;

a second signal line;

a scan line;

a light emitting element;

a power supply line;

a first transistor connected to the first signal line and the scan line;

a first capacitor connected to the first transistor and the power supply line;

a first driving transistor of which a gate electrode is connected to the first capacitor, a drain electrode of the first driving transistor being connected to the light emitting element and a source electrode of the first driving transistor being connected to an anode;

a second transistor connected to the second signal line and the scan line;

a second capacitor connected to the second transistor and the power supply line; and a second driving transistor of which a gate electrode is connected to the second capacitor, a drain electrode of the second driving transistor being connected to the light emitting element and a source electrode of the second driving transistor being connected to the anode, wherein a voltage between a gate and a drain of the first driving transistor and a voltage between a gate and a drain of the second driving transistor are different.

21. The display device according to claim 20, further comprising a unit for driving transistors connected to the light emitting element in accordance with a luminance of the light emitting element.

22. The display device according to claim 20, wherein the display device is used for an electronic device selected from the group consisting of an EL display, a video camera, a personal computer, a portable information terminal, a portable phone, and a digital camera.

23. A display device comprising:

a signal line;

a scan line;

a first light emitting element;

a second light emitting element;

a transistor connected to the signal line and the scan line;

a first driving transistor connected to the transistor, a drain electrode of the first driving transistor being connected to the first light emitting element and a source electrode of the first driving transistor being connected to an anode;

a current source connected to the first driving transistor; and a second driving transistor connected to the transistor, a drain electrode of the second driving transistor being connected to the second light emitting element and a source electrode of the second driving transistor being connected to the anode.

24. The display device according to claim 23, wherein the display device is used for an electronic device selected from the group consisting of an EL display, a video camera, a personal computer, a portable information terminal, a portable phone, and a digital camera.

25. A display device comprising:

a signal line;

a scan line;

a first light emitting element;

a second light emitting element;

a transistor connected to the signal line and the scan line;

a first driving transistor connected to the transistor, a drain electrode of the first driving transistor being connected to the first light emitting element and a source electrode of the first driving transistor being connected to an anode;

a current source connected to the first driving transistor; and a second driving transistor connected to the transistor, a drain electrode of the second driving transistor being connected to the second light emitting element and a source electrode of the second driving transistor being connected to the anode, wherein the first driving transistor and the second driving transistor have different current capacities.

26. The display device according to claim 25, wherein the display device is used for an electronic device selected from the group consisting of an EL display, a video camera, a personal computer, a portable information terminal, a portable phone, and a digital camera.

27. The display device according to claim 23, wherein the first light emitting element and the second light emitting element are in a same pixel.

28. The display device according to claim 25, wherein the first light emitting element and the second light emitting element are in a same pixel.

* * * * *